US011774998B2

(12) United States Patent
Wang et al.

(10) Patent No.: US 11,774,998 B2
(45) Date of Patent: Oct. 3, 2023

(54) REFERENCE CURRENT/VOLTAGE GENERATOR AND CIRCUIT SYSTEM USING THE SAME

(71) Applicant: NUVOTON TECHNOLOGY CORPORATION, Hsinchu (TW)

(72) Inventors: Hui-Chun Wang, Hsinchu (TW); Yeh-Tai Hung, Hsinchu (TW); Hua-Chun Tseng, Hsinchu (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 98 days.

(21) Appl. No.: 17/401,917

(22) Filed: Aug. 13, 2021

(65) Prior Publication Data

US 2023/0009763 A1 Jan. 12, 2023

(30) Foreign Application Priority Data

Jul. 7, 2021 (TW) ..... 110124955

(51) Int. Cl.
*G05F 3/26* (2006.01)

(52) U.S. Cl.
CPC ..... *G05F 3/262* (2013.01)

(58) Field of Classification Search
CPC ..... G05F 3/262
See application file for complete search history.

(56) References Cited

U.S. PATENT DOCUMENTS 10,061,340 B1* 8/2018 Rao et al. ..... G05F 3/267
2005/0110476 A1* 5/2005 Mukherjee et al. ..... G05F 3/30 323/313
2012/0212208 A1* 8/2012 Yao et al. ..... G05F 3/30 323/313
2018/0210480 A1* 7/2018 Sone ..... G05F 3/267
2019/0101948 A1* 4/2019 Eberlein ..... G05F 3/225
2019/0129461 A1* 5/2019 Sone ..... G05F 3/225
2021/0356983 A1* 11/2021 Sone ..... G05F 3/267
2022/0244749 A1* 8/2022 Yang et al. ..... G05F 1/567

FOREIGN PATENT DOCUMENTS

CN 102622032 A * 8/2012
CN 109725676 A * 5/2019 .....G05F 3/225

* cited by examiner

*Primary Examiner* — Sisay G Tiku
(74) *Attorney, Agent, or Firm* — Muncy, Geissler, Olds & Lowe, P.C.

(57) ABSTRACT

A reference current/voltage generator includes a current mirror unit and a current-mode temperature compensation unit. The current mirror unit generates a first current, a first sum current and a second sum current flowing through first to third terminals thereof, and the first current, the first sum current and the second sum current are in a multiple relationship. The current-mode temperature compensation unit is electrically connected to the second and third terminals of the current mirror unit, and when a voltage on the second terminal is equal to a voltage on the third terminal, the first sum current is a sum of a current proportional to absolute temperature (PTAT) and a current complementary to absolute temperature (CTAT). The first terminal of the current mirror unit is an output terminal of the reference current/voltage generator and configured to output the first current as a reference current.

16 Claims, 4 Drawing Sheets

REFERENCE CURRENT/VOLTAGE GENERATOR AND CIRCUIT SYSTEM USING THE SAME

BACKGROUND

1. Technical Field

The present disclosure is related to a reference current/voltage generator, and more particularly to a reference current/voltage generator which is independent from a temperature change, and a circuit system using the above-mentioned reference current/voltage generator.

2. Description of the Related Art

Most of the conventional reference voltage generators use bandgap reference circuits to generate a bandgap reference voltage (VBG), which is proportional to absolute temperature (PTAT). Because of the characteristics of the bandgap reference circuit, the range of the bandgap reference voltage is limited. In order to supply a higher reference voltage, the bandgap reference voltage is outputted through an additional operational amplifier and voltage divider resistors, so as to generate the required reference voltage based on the energy gap reference voltage. However, the operational amplifier not only consumes a lot of power, but also requires a considerable chip area for implementation.

In low voltage circuit system, the higher reference voltage is not required, so the bandgap reference voltage (VBG) can be directly used as the output reference voltage and the operational amplifier is not required to amplify the bandgap reference voltage (VBG); however, the reference voltage outputted from the conventional reference voltage generator may vary due to temperature change and power supply change. Therefore, in order to solve this technical problem, some companies use feedback circuits, which generate corresponding control signals based on the output reference voltage changes, to control the switching operation of switches in the reference voltage generator, so as to suppress the impact on the output reference voltage due to the temperature change and power supply change. However, the scheme of sensing the output reference voltage to generate a feedback signal needs a comparator and a switch, and it decreases the operating bandwidth and operating speed and increases the chip area and power consumption.

SUMMARY

In order to solve the conventional problems, the present disclosure provides a reference current/voltage generator including a current mirror unit and a current-mode temperature compensation unit. The current mirror unit includes a first terminal, a second terminal and a third terminal, and configured to receive a supply voltage and generate a first current, a first sum current and a second sum current flowing through the first terminal, the second terminal and the third terminal, respectively. The first current, the first sum current and the second sum current are in a multiple relationship. The current-mode temperature compensation unit includes a BJT-based bandgap circuit and a first impedance circuit. The BJT-based bandgap circuit includes a first circuit and a second circuit; two terminals of each of the first circuit and the second circuit are electrically connected to the second terminal and the third terminal of the current mirror unit, respectively. The first impedance circuit is electrically connected to the second terminal of the current mirror unit and electrically connected in parallel to the first circuit. A connection node between the first impedance circuit and the first circuit receives the first sum current, the two terminals of the first circuit and the second circuit electrically connected to the second terminal and the third terminal of the current mirror unit are biased by a first voltage and a second voltage, respectively. When the first voltage is equal to the second voltage, the first circuit generates the second current, the first impedance circuit generates the third current, wherein the second current is proportional to absolute temperature (PTAT), and the third current is complementary to absolute temperature (CTAT). The first terminal of the current mirror unit is an output terminal of the reference current/voltage generator and configured to output the first current as a reference current.

According to an embodiment, the reference current/voltage generator further includes an impedance element electrically connected to the first terminal of the current mirror unit, and configured to receive the first current and generate a reference voltage.

According to an embodiment, the current mirror unit includes first to ninth transistors, and sources of the first to fifth transistors are configured to receive the supply voltage, a gate of the third transistor is electrically connected to gates of the fourth transistor and the fifth transistor and the drain of the first transistor, a gate of the second transistor is electrically connected to a gate of the first transistor and a drain of the second transistor, a drain of the eighth transistor is electrically connected to a drain of the third transistor and gates of the seventh to eighth transistor, a drain of the sixth transistor is electrically connected to a drain of the first transistor, a drain of the ninth transistor is electrically connected to a drain of the fourth transistor and gates of the ninth and sixth transistors, a drain of the seventh transistor is electrically connected to a drain of the second transistor, sources of the sixth and eighth transistors are electrically connected to the second terminal of the current mirror unit, and sources of the seventh and ninth transistors are electrically connected to the third terminal of the current mirror unit, and a drain of the fifth transistor is electrically connected to the first terminal of the current mirror unit.

According to an embodiment, each of the first to fifth transistors can be a P-type MOS transistor, and each of the sixth to ninth transistors can be a N-type MOS transistor.

According to an embodiment, the first circuit includes a tenth transistor and a first impedance element, the first impedance circuit includes a second impedance element, the second circuit comprises an eleventh transistor, a first terminal and a second terminal of the second impedance element are electrically connected to the second terminal of the current mirror unit and a ground voltage, respectively, and a base and a collector of the tenth transistor are electrically connected to the ground voltage, a first terminal and a second terminal of the first impedance element are electrically connected to the second terminal of the current mirror unit and an emitter of the tenth transistor, respectively, and a base and a collector of the eleventh transistor are electrically connected to the ground voltage, and an emitter of the eleventh transistor is connected to the third terminal of the current mirror unit.

According to an embodiment, the current-mode temperature compensation unit includes a second impedance circuit, and a first terminal and a second terminal of the second impedance circuit are electrically connected to the third terminal of the current mirror unit and the ground voltage, respectively, and the second impedance circuit and the second circuit are electrically connected in parallel, and a connection node between the second impedance circuit and the second circuit receives the second sum current.

According to an embodiment, each of the tenth and eleventh transistors is a PNP-type BJT transistor.

According to an embodiment, the current mirror unit comprises first to fourth native transistors, and drains of the first to fourth native transistors are electrically connected to drains of the first to fourth transistors, respectively, and sources of the first to fourth native transistors are electrically connected to sources of the sixth to ninth transistors, respectively, and gates of the first to fourth native transistors are electrically connected to a gate of the sixth transistor, and gates of the second native transistor and third native transistor are electrically connected to a gate of the seventh transistor.

According to an embodiment, each of the first to fourth native transistors is a N-type native MOS transistor.

According to an embodiment, the present disclosure further provides a circuit system including the above-mentioned reference current/voltage generator and a load, and the load is electrically connected to the output terminal of the reference current/voltage generator.

According to above-mentioned contents, the embodiment of the present disclosure provides a reference current/voltage generator which is independent from temperature change, that is, the reference current/voltage generated by the reference current/voltage generator is affected by temperature change, and the generated reference current/voltage is a reference current/voltage with zero temperature coefficient.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
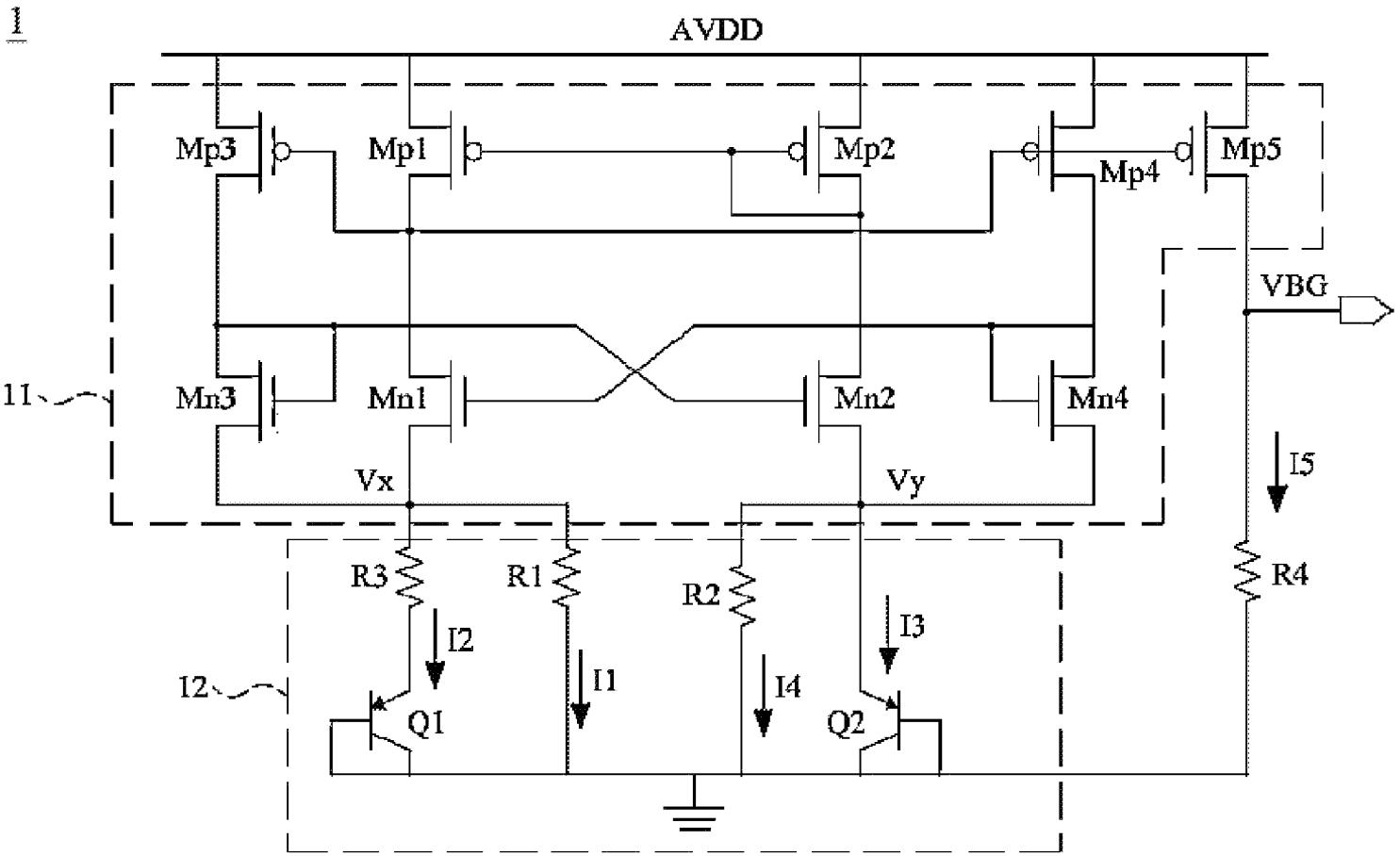
FIG. 1 is a circuit diagram of a reference current/voltage generator according to an embodiment of the present disclosure.

The following embodiments of the present disclosure are herein described in detail with reference to the accompanying drawings. These drawings show specific examples of the embodiments of the present disclosure. These embodiments are provided so that this disclosure will be thorough and complete, and will fully convey the scope of the disclosure to those skilled in the art. It is to be acknowledged that these embodiments are exemplary implementations and are not to be construed as limiting the scope of the present disclosure in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

The embodiment of the present disclosure provides a reference current/voltage generator which is independent from (that is, irrelevant to) temperature change and does not need a feedback circuit for sensing the output reference voltage, and additional operational amplifier and a switch, so as to solve the conventional technology problem. In the reference current/voltage generator of an embodiment of the present disclosure, a current mirror unit and a current-mode temperature compensation unit are connected in cascode, and voltages on two terminals connected to the current mirror unit and the current-mode temperature compensation unit are designed to be equal to each other, so that the at least one of the two currents flowing through the two terminals, connected to the current mirror unit and the current-mode temperature compensation unit, can become a sum of a current with positive temperature coefficient and a current with negative temperature coefficient; the current with positive temperature coefficient is proportional to absolute temperature (PTAT), and the current with negative temperature coefficient is complementary to absolute temperature (CTAT). Therefore, the reference current outputted from the current mirror unit is a current irrelevant to (that is, independent from) the temperature change, and also called a current with zero temperature coefficient. Furthermore, the voltage on the impedance element of the output terminal of the reference current/voltage generator is a product of the reference current and the resistance value of the impedance element, and the voltage can be used as the reference voltage irrelevant to the temperature change. Furthermore, in an embodiment of the present disclosure, the current mirror unit can include a plurality of native transistors disposed on flowing paths where the current flowing through the two terminals connected to the current mirror unit and the current-mode temperature compensation unit, so as to decrease the effect on the output reference current/voltage due to a change in the supply voltage.

Please refer to FIG. 1, which is a circuit diagram of a reference current/voltage generator according to an embodiment of the present disclosure. The reference current/voltage generator 1 includes a current mirror unit 11, a current-mode temperature compensation unit 12 and an impedance element R4. The current mirror unit 11 is configured to receive the supply voltage AVDD and includes a first terminal, a second terminal and a third terminal corresponding to the voltages VBG, Vx and Vy, respectively. The current unit 11 generates currents flowing through the first terminal, the second terminal and the third terminal, respectively; the current I5 flowing through the first terminal, the sum current (I1+I2) flowing through the second terminal, and the sum current (I3+I4) flowing through the third terminal are in a multiple relationship, such as 1:K:1, wherein K is a number greater than 0. The current-mode temperature compensation unit 12 is electrically connected to the current mirror unit 11 through the second terminal and the third terminal, and the current-mode temperature compensation unit 12 and the current mirror unit 11 are connected in cascode, so that the current mirror unit 11 can be electrically connected to a low voltage (such as a ground voltage) through the current-mode temperature compensation unit 12.

When the voltage Vx is equal to the voltage Vy, the current I1 and the current I2 generated by the current-mode temperature compensation unit 12 and flowing through the second terminal are a current with negative temperature coefficient and a current with positive temperature coefficient, respectively. As a result, with appropriate design, the sum current (I1+I2) flowing through the second terminal can be a current with zero temperature coefficient; the current I5 flowing through the first terminal, the sum current (I1+I2) flowing through the second terminal and the sum current (I3+I4) flowing through the third terminal are in a multiple relationship, so the sum current (I3+I4) generated by the current-mode temperature compensation unit 12 and flowing through the third terminal can also be a current with zero temperature coefficient, and the current I5 outputted by the current mirror unit 11 and flowing through the first terminal is also a current with zero temperature coefficient.

The two terminals of the impedance element R4 are electrically connected between the first terminal and the low voltage, the first terminal serves as the output terminal of the reference current/voltage generator 1, and the current I5 serves as the reference current outputted by the reference current/voltage generator 1; the voltage VBG generated by the current I5 flowing through the impedance element R4 serves as the reference voltage outputted from the reference current/voltage generator 1. As a result, the reference current and the reference voltage outputted by the reference current/voltage generator 1 are the reference current with zero temperature coefficient and the reference voltage with zero temperature coefficient, respectively, so as to achieve the purpose of making the reference current and the reference voltage independent from the temperature change. Furthermore, in this embodiment, the impedance element R4 is implemented by a resistor, but the present disclosure is not limited thereto.

Furthermore, the exemplary implementation of the current mirror unit 11 will be described in the following paragraphs, but the present disclosure is not limited to the exemplary implementation. The current mirror unit 11 includes transistors M*p*1~M*p*5 and transistors M*n*1~M*n*4; each of the transistors M*p*1~M*p*5 is a P-type MOS transistor, and each of the transistors M*n*1~M*n*4 is a N-type MOS transistor. The sources of the transistors M*p*1~M*p*5 receive the supply voltage AVDD, the gate of the transistor M*p*3 is electrically connected to the gates of the transistors M*p*4 and M*p*5 and the drain of the transistor M*p*1, a gate of the transistor M*p*2 is electrically connected to a gate of the transistor M*p*1 and a drain of the transistor M*p*2; a drain of the transistor M*n*3 is electrically connected to a drain of the transistor M*p*3 and gates of the transistors M*n*3 and M*n*2; a drain of the transistor M*n*1 is electrically connected to a drain of the transistor M*p*1, and a drain of the transistor M*n*4 is electrically connected to a drain of the transistor M*p*4 and gates of the transistor M*n*4 and M*n*1, and a drain of the transistor M*n*2 is electrically connected to a drain of the transistor M*p*2. The gates of the transistors M*n*1~M*n*4 are electrically connected to each other in an interactive coupling manner. The sources of the transistors M*n*1 and M*n*3 are electrically connected to the second terminal, and the voltage Vx is generated on the second terminal. The sources of the transistors M*n*2 and M*n*4 are electrically connected to the third terminal, and the voltage Vy is generated on the third terminal. The drain of the transistor M*p*5 is electrically connected to the first terminal, and the voltage VBG is generated on the first terminal.

Furthermore, the implementation of the current-mode temperature compensation unit 12 will be described in the following paragraphs, but the present disclosure is not limited to the exemplary implementation of the current-mode temperature compensation unit 12. The current-mode temperature compensation unit 12 can include transistors Q1 and Q2, and impedance elements R1~R3; each of the transistors Q1 and Q2 can be a PNP-type BJT transistor, and each of the impedance elements R1~R3 can be a resistor. A base and a collector of the transistor Q1 are electrically connected to the low voltage, an emitter of the transistor Q2 is electrically connected to the third terminal of the current mirror unit 11; a base and a collector of the transistor Q2 are electrically connected to the low voltage. The first terminals of the resistors R1 and R3 are electrically connected to the second terminal of the current mirror unit 11, a second terminal of the resistor R1 is electrically connected to the emitter of the transistor Q1, and a second terminal of the resistor R3 is electrically connected to the low voltage. A first terminal of the resistor R2 is electrically connected to a third terminal of the current mirror unit 11, and a second terminals of the resistor R2 are electrically connected to the low voltage.

The exemplary implementation of the current-mode temperature compensation unit 12 will be illustrated in the following paragraphs in another viewpoint. The current-mode temperature compensation unit 12 can include a BJT-based bandgap circuit, a first impedance circuit and a second impedance circuit. The BJT-based bandgap circuit is formed by the transistors Q1 and Q2 and the impedance element R3, the first impedance circuit is formed by the impedance element R1, and the second impedance circuit is formed by the impedance element R2. The BJT-based bandgap circuit includes a first circuit and a second circuit, the first circuit is formed by the transistor Q1 and the impedance element R3, and the second circuit is formed by the transistor Q2. The first circuit is parallelly connected to the first impedance circuit, which is formed by the impedance element R1; the connection node between the first circuit and the first impedance circuit can receive the first sum current. The second circuit is parallelly connected to the second impedance circuit, which is formed by the impedance element R2; the connection node between the second circuit and the second impedance circuit can receive the second sum current. The voltages Vx and Vy are used to bias the first circuit and the second circuit, respectively; in a condition that the voltage Vx is equal to the voltage Vy, the current I1 generated by the first impedance circuit decreases with the increasing of temperature, and the current I1 is also called the current ($I_{CTAT}$) with negative temperature coefficient; the current I2 generated by the first circuit increases with the increasing of temperature, and the current I2 is also called the current ($I_{PTAT}$) with positive temperature coefficient.

Figure 2:
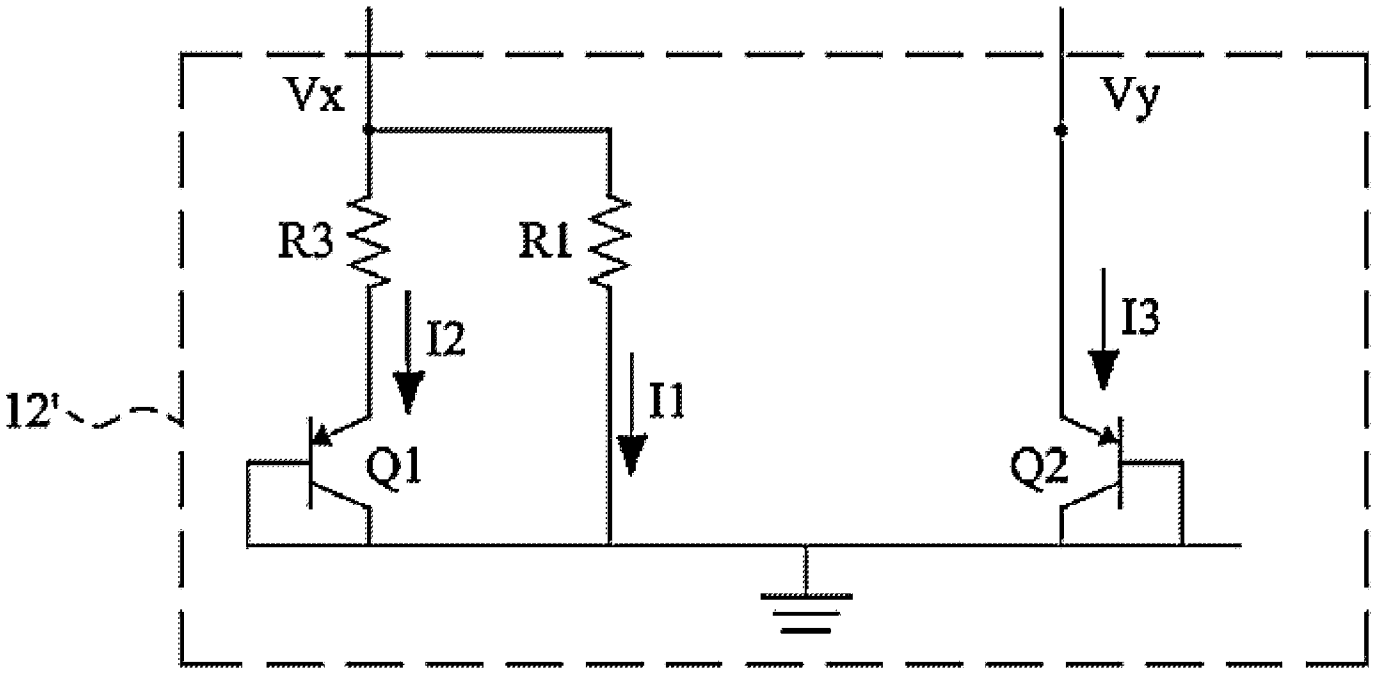
FIG. 2 is a circuit diagram of a current-mode temperature compensation unit of a reference current/voltage generator according to an embodiment of the present disclosure.

Besides the embodiment shown in FIG. 1, the current-mode temperature compensation unit 12 can be implemented by other embodiment. Please refer to FIG. 2, which is a circuit diagram of a current-mode temperature compensation unit of a reference current/voltage generator according to an embodiment of the present disclosure. The difference between the current-mode temperature compensation unit 12 of FIG. 1 and the current-mode temperature compensation unit 12′ of FIG. 2 is that the current-mode temperature compensation unit 12′ of FIG. 2 does not include the impedance element R2, and the current flows through the third terminal include the current I3 only. In any one of embodiments shown in FIG. 1 and FIG. 2, when the voltage Vx is equal to the voltage VY, the current I1 is equal to Vbe2/R1, the current I2 is equal to (Vx-Vbe1)/R3=(Vbe2-Vbe1)/R3=$V_T$lnK/R3, wherein Vbe1 and Vbe2 are base-emitter voltages of the transistors Q1 and Q2, respectively, $V_T$ is a thermal voltage, and K is a constant. The current I1 deceases with the increasing of temperature and is also called the current $I_{CTAT}$ with negative temperature coefficient; the current I2 increases with the increasing of temperature and is also called the current $I_{PTAT}$ with positive temperature coefficient. The sum current flowing through the second terminal of the current mirror unit 11 satisfies the following condition:

$$I1+I2=I_{CTAT}+I_{PTAT}$$
$$=V_T\ln K/R3+Vbe2/R1=V_T/R3(\ln K+R3Vbe2/V_TR1)$$

Therefore, with appropriate design, the sum current flowing through the second terminal of the current mirror unit 11 can be the current with zero temperature coefficient. Furthermore, it is to be noted that BJT transistors are taken as examples of the transistors Q1 and Q2 for illustration, but the transistors Q1 and Q2 can be implemented by MOS transistors for temperature compensation in other embodiment, and the types of the transistors Q1 and Q2 of the present disclosure are not limited to above-mentioned examples.

Figure 3:
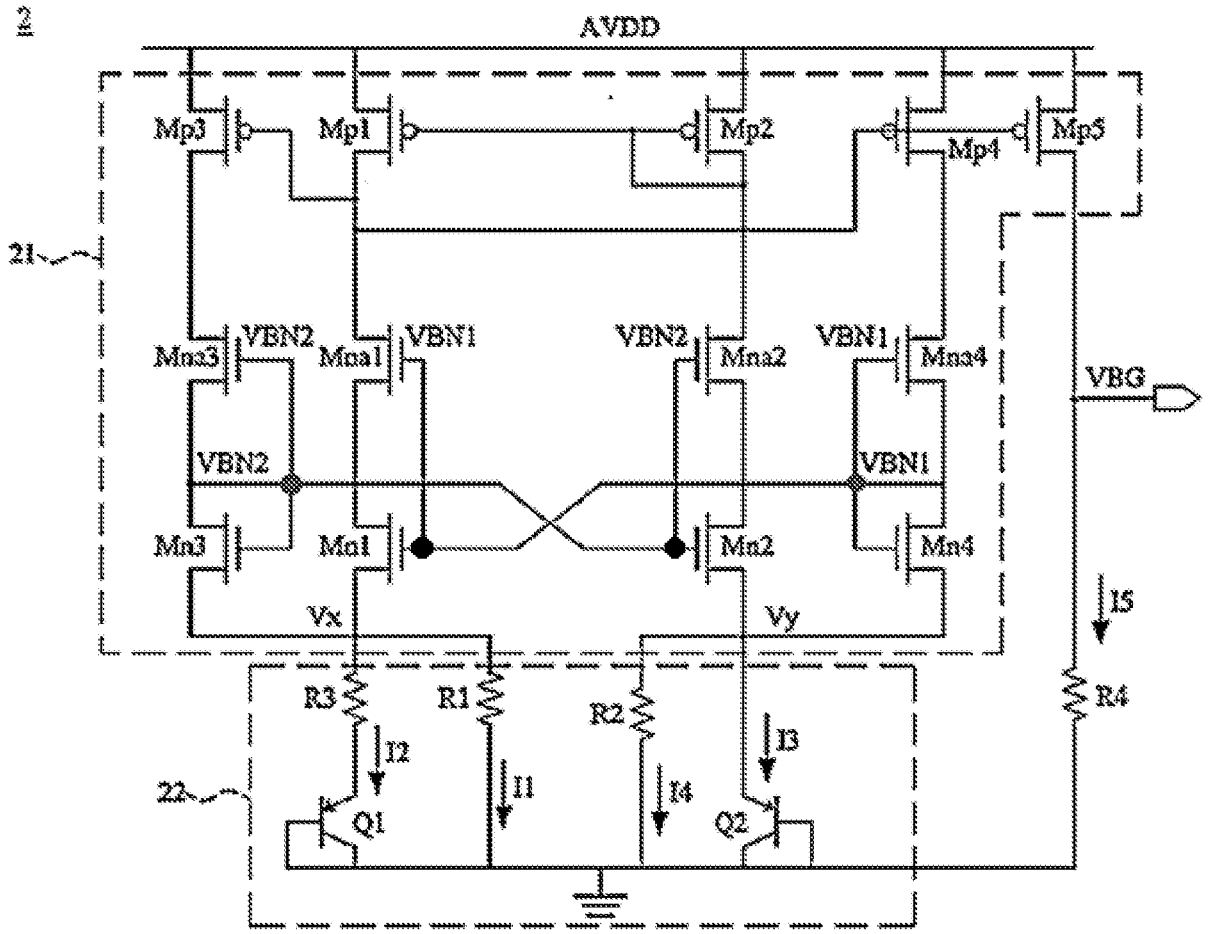
FIG. 3 is a circuit diagram of a reference current/voltage generator according to another embodiment of the present disclosure.

Please refer to FIG. 3, which is a circuit diagram of a reference current/voltage generator according to another embodiment of the present disclosure. The reference current/voltage generator 2 shown in FIG. 3 is substantially similar to the reference current/voltage generator 1 shown in FIG. 1, the current-mode temperature compensation unit 22 and the impedance element R4 of FIG. 3 are the same as the current-mode temperature compensation unit 12 and the impedance element R4 of FIG. 1, and the difference between the embodiment of FIG. 3 and the embodiment of FIG. 1 is that the current mirror unit 21 of FIG. 3 includes native transistors M*na*1~M*na*4; for example, each of the native transistors M*na*1~M*na*4 can be a N-type native MOS transistor. The drains of the native transistors M*na*1~M*na*4 are electrically connected to the drains of the transistors M*p*1~M*p*4, respectively; sources of the native transistors M*na*1~M*na*4 are electrically connected to sources of the transistors M*n*1~M*n*4, respectively. The gates of the native transistors M*na*1 and M*na*4 are electrically connected to the gate of the transistor M*n*1 and configured to receive a voltage VBN1 on the gate of the transistor M*n*1; the gates of the native transistors M*na*2 and M*na*3 are electrically connected to the gate of the transistor M*n*2 and configured to receive a voltage VBN2 on the gate of the transistor M*n*2. The native transistors M*na*1~M*na*4 are connected in cascode between the transistors M*p*1~M*p*4 and the transistors M*n*1~M*n*4, so as to decrease the effect on the reference current/voltage, generated by the reference current/voltage generator 2, due to the change in the supply voltage AVDD.

Please refer to FIG. 3, which is a circuit diagram of a reference current/voltage generator according to another embodiment of the present disclosure. The reference current/voltage generator 2 shown in FIG. 3 is substantially similar to the reference current/voltage generator 1 shown in FIG. 1, the current-mode temperature compensation unit 22 and the impedance element R4 of FIG. 3 are the same as the current-mode temperature compensation unit 12 and the impedance element R4 of FIG. 1, and the difference between the embodiment of FIG. 3 and the embodiment of FIG. 1 is that the current mirror unit 21 of FIG. 3 includes native transistors M*na*1~M*na*4; for example, each of the native transistors M*na*1~M*na*4 can be a N-type native MOS transistor. The drains of the native transistors M*na*1~M*na*4 are electrically connected to the drains of the transistors M*p*1~M*p*4, respectively; sources of the native transistors M*na*1~M*na*4 are electrically connected to drains of the transistors M*n*1~M*n*4, respectively. The gates of the native transistors M*na*1 and M*na*4 are electrically connected to the gate of the transistor M*n*1 and configured to receive a voltage VBN1 on the gate of the transistor M*n*1; the gates of the native transistors M*na*2 and M*na*3 are electrically connected to the gate of the transistor M*n*2 and configured to receive a voltage VBN2 on the gate of the transistor M*n*2. The native transistors M*na*1~M*na*4 are connected in cascode between the transistors M*p*1~M*p*4 and the transistors M*n*1~M*n*4, so as to decrease the effect on the reference current/voltage, generated by the reference current/voltage generator 2, due to the change in the supply voltage AVDD.

Figure 4:
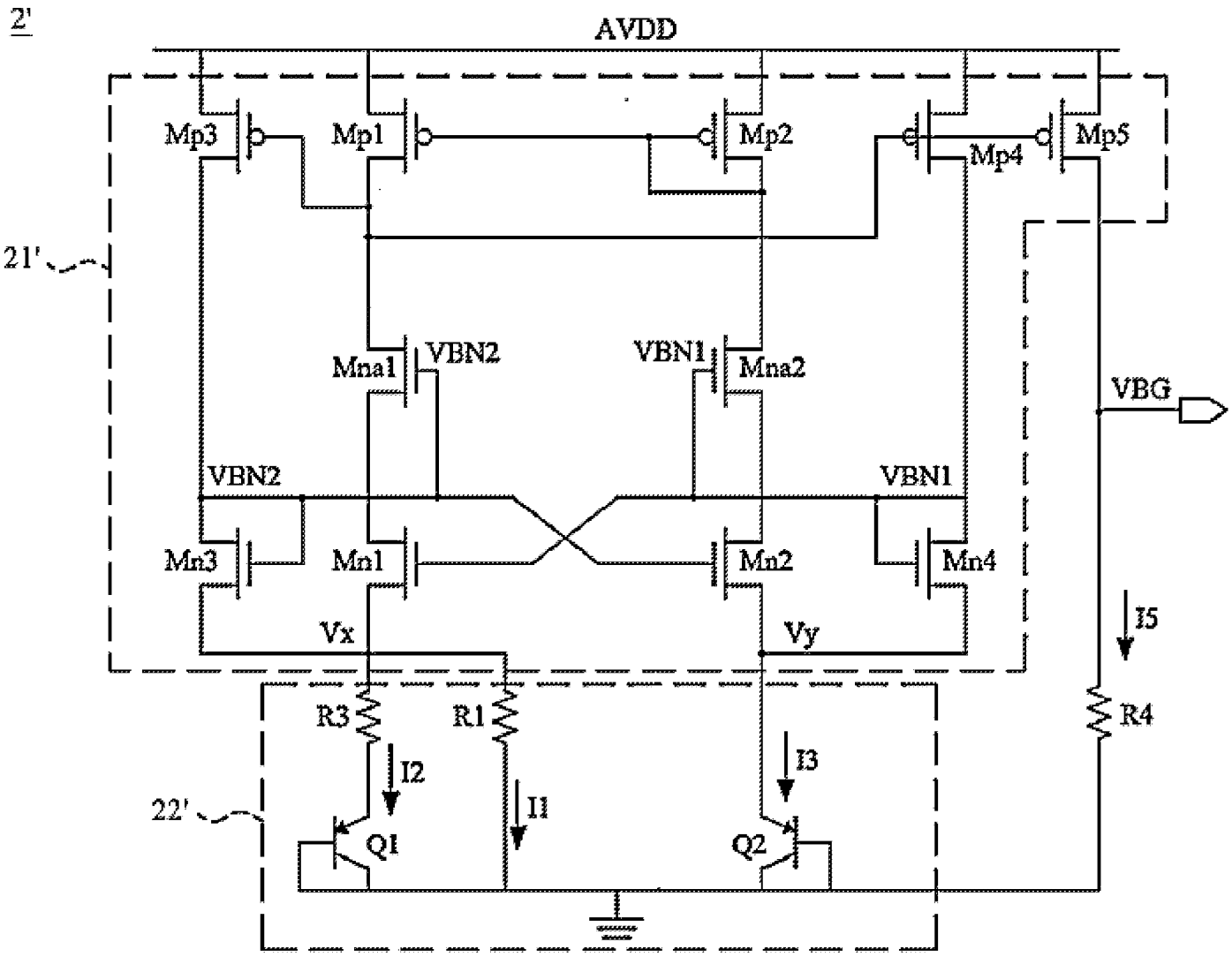
FIG. 4 is a circuit diagram of a reference current/voltage generator according to another embodiment of the present disclosure.

Please refer to FIG. 4, which is a circuit diagram of a reference current/voltage generator according to another embodiment of the present disclosure. The reference current/voltage generator 2′ shown in FIG. 4 is substantially similar to the reference current/voltage generator 2 shown in FIG. 3, the difference between the reference current/voltage generator 2′ and the reference current/voltage generator 2 is that the current-mode temperature compensation unit 22′ of FIG. 4 adopts the design of the current-mode temperature compensation unit 12′ of FIG. 2, and compared with the current mirror unit 21 of FIG. 3, the current mirror unit 21′ of FIG. 4 includes the native transistors M*na*1 and M*na*2 and omits the native transistors M*na*3 and M*na*4; for example, each of the native transistors M*na*1 and M*na*2 is a N-type native MOS transistor. The drains of the native transistors M*na*1 and M*na*2 are electrically connected to the drains of the transistors M*p*1 and M*p*2, respectively; the sources of the native transistors M*na*1 and M*na*2 are electrically connected to the drains of the transistors M*n*1 and M*n*2, respectively. The gate of the native transistor M*na*1 is electrically connected to the gate of the transistor M*n*2 and configured to receive a voltage VBN2 on the gate of the transistor M*n*2, and the gate of the native transistor M*na*2 is electrically connected to the gate of the transistor M*n*1 and configured to receive a voltage VBN1 on the gate of the transistor M*n*1. The native transistors M*na*1 and M*na*2 are connected in cascode between the transistors M*p*2 and M*p*4 and the transistors M*n*1 and M*n*2, so as to decrease the effect on the reference current/voltage, generated by the reference current/ voltage generator 2', due to the change in the supply voltage AVDD.

According above-mentioned contents, the embodiment of the present disclosure provides the reference current/voltage generator which is independent from a temperature change, and the reference current/voltage generator can generate the sum current including the current with positive temperature coefficient and the current with negative temperature coefficient, and mirror the sum current as the output reference current, so that the output reference current can be substantially independent from the temperature change, and the reference voltage generated by the reference current can also be independent from the temperature change. Compared with conventional technology, the reference current/voltage generator of the embodiment of the present disclosure does not need the feedback circuit for sensing the output reference voltage and also does not need an operational amplifier and a switch, so as to prevent the problem of decreasing the operation bandwidth and operation speed and increasing chip area and power consumption.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A reference current/voltage generator, comprising:

a current mirror unit comprising a first terminal, a second terminal and a third terminal, and configured to receive a supply voltage and generate a first current, a first sum current and a second sum current flowing through the first terminal, the second terminal and the third terminal, respectively, wherein the first current, the first sum current and the second sum current are in a multiple relationship; and a current-mode temperature compensation unit comprising:

a BJT-based bandgap circuit comprising a first circuit and a second circuit, wherein two terminals of each of the first circuit and the second circuit are electrically connected to the second terminal and the third terminal of the current mirror unit, respectively; and a first impedance circuit electrically connected to the second terminal of the current mirror unit and electrically connected in parallel to the first circuit, wherein a connection node between the first impedance circuit and the first circuit receives the first sum current, the two terminals of the first circuit and the second circuit electrically connected to the second terminal and the third terminal of the current mirror unit are biased by a first voltage and a second voltage, respectively, wherein when the first voltage is equal to the second voltage, the first circuit generates a second current, the first impedance circuit generates the-a third current, wherein the second current is proportional to absolute temperature (PTAT), and the third current is complementary to absolute temperature (CTAT);

wherein the first terminal of the current mirror unit is an output terminal of the reference current/voltage generator and configured to output the first current as a reference current;

wherein the first circuit comprises a tenth transistor and a first impedance element, the first impedance circuit comprises a second impedance element, the second circuit comprises an eleventh transistor, a first terminal and a second terminal of the second impedance element are electrically connected to the second terminal of the current mirror unit and a ground voltage, respectively, and a base and a collector of the tenth transistor are electrically connected to the ground voltage, a first terminal and a second terminal of the first impedance element are electrically connected to the second terminal of the current mirror unit and an emitter of the tenth transistor, respectively, and a base and a collector of the eleventh transistor are electrically connected to the ground voltage, and an emitt er of the eleventh transistor is connected to the third terminal of the current mirror unit.

2. The reference current/voltage generator according to claim 1, further comprising:

an impedance element electrically connected to the first terminal of the current mirror unit, and configured to receive the first current and generate a reference voltage.

3. The reference current/voltage generator according to claim 1, wherein the current mirror unit comprises first to ninth transistors, and sources of the first to fifth transistors are configured to receive the supply voltage, a gate of the third transistor is electrically connected to gates of the fourth transistor and the fifth transistor and a drain of the first transistor, a gate of the second transistor is electrically connected to a gate of the first transistor and a drain of the second transistor, a drain of the eighth transistor is electrically connected to a drain of the third transistor and gates of the seventh to eighth transistor, a drain of the sixth transistor is electrically connected to the drain of the first transistor, a drain of the ninth transistor is electrically connected to a drain of the fourth transistor and gates of the ninth and sixth transistors, a drain of the seventh transistor is electrically connected to the drain of the second transistor, sources of the sixth and eighth transistors are electrically connected to the second terminal of the current mirror unit, and sources of the seventh and ninth transistors are electrically connected to the third terminal of the current mirror unit, and a drain of the fifth transistor is electrically connected to the first terminal of the current mirror unit.

4. The reference current/voltage generator according to claim 3, wherein each of the first to fifth transistors is a P-type MOS transistor, and each of the sixth to ninth transistors is a N-type MOS transistor.

5. The reference current/voltage generator according to claim 3, wherein the current mirror unit comprises first to fourth native transistors, and drains of the first to fourth native transistors are electrically connected to drains of the first to fourth transistors, respectively, and sources of the first to fourth native transistors are electrically connected to sources of the sixth to ninth transistors, respectively, and gates of the first and fourth native transistors are electrically connected to a gate of the sixth transistor, and gates of the second native transistor and third native transistor are electrically connected to a gate of the seventh transistor.

6. The reference current/voltage generator according to claim 5, wherein each of the first to fourth native transistors is a N-type native MOS transistor.

7. The reference current/voltage generator according to claim 1, wherein the current-mode temperature compensation unit comprises a second impedance circuit, and a first terminal and a second terminal of the second impedance circuit are electrically connected to the third terminal of the current mirror unit and the ground voltage, respectively, and the second impedance circuit and the second circuit are electrically connected in parallel, and a connection node between the second impedance circuit and the second circuit receives the second sum current.

8. The reference current/voltage generator according to claim 1, wherein each of the tenth and eleventh transistors is a PNP-type BJT transistor.

9. A circuit system, comprising:

a reference current/voltage generator, comprising:

a current mirror unit comprising a first terminal, a second terminal and a third terminal, and configured to receive a supply voltage and generate a first current, a first sum current and a second sum current flowing through the first terminal, the second terminal and the third terminal, respectively, wherein the first current, the first sum current and the second sum current are in a multiple relationship; and a current-mode temperature compensation unit comprising:

a BJT-based bandgap circuit comprising a first circuit and a second circuit, wherein two terminals of each of the first circuit and the second circuit are electrically connected to the second terminal and the third terminal of the current mirror unit, respectively; and a first impedance circuit electrically connected to the second terminal of the current mirror unit and electrically connected in parallel to the first circuit, wherein a connection node between the first impedance circuit and the first circuit receives the first sum current, the two terminals of the first circuit and the second circuit electrically connected to the second terminal and the third terminal of the current mirror unit are biased by a first voltage and a second voltage, respectively, wherein when the first voltage is equal to the second voltage, the first circuit generates a second current, the first impedance circuit generates the-a third current, wherein the second current is proportional to absolute temperature (PTAT), and the third current is complementary to absolute temperature (CTAT);

wherein the first terminal of the current mirror unit is an output terminal of the reference current/voltage generator and configured to output the first current as a reference current; and a load electrically connected to the output terminal of the reference current/voltage generator;

wherein the first circuit comprises a tenth transistor and a first impedance element, the first impedance circuit comprises a second impedance element, the second circuit comprises an eleventh transistor, a first terminal and a second terminal of the second impedance element are electrically connected to the second terminal of the current mirror unit and a ground voltage, respectively, and a base and a collector of the tenth transistor are electrically connected to the ground voltage, a first terminal and a second terminal of the first impedance element are electrically connected to the second terminal of the current mirror unit and an emitter of the tenth transistor, respectively, and a base and a collector of the eleventh transistor are electrically connected to the ground voltage, and an emitter of the eleventh transistor is connected to the third terminal of the current mirror unit.

10. The circuit system according to claim 9, wherein the reference current/voltage generator further comprises:

an impedance element electrically connected to the first terminal of the current mirror unit, and configured to receive the first current and generate a reference voltage.

11. The circuit system according to claim 9, wherein the current mirror unit comprises first to ninth transistors, and sources of the first to fifth transistors are configured to receive the supply voltage, a gate of the third transistor is electrically connected to gates of the fourth transistor and the fifth transistor and a drain of the first transistor, a gate of the second transistor is electrically connected to a gate of the first transistor and a drain of the second transistor, a drain of the eighth transistor is electrically connected to a drain of the third transistor and gates of the seventh to eighth transistor, a drain of the sixth transistor is electrically connected to the drain of the first transistor, a drain of the ninth transistor is electrically connected to a drain of the fourth transistor and gates of the ninth and sixth transistors, a drain of the seventh transistor is electrically connected to the drain of the second transistor, sources of the sixth and eighth transistors are electrically connected to the second terminal of the current mirror unit, and sources of the seventh and ninth transistors are electrically connected to the third terminal of the current mirror unit, and a drain of the fifth transistor is electrically connected to the first terminal of the current mirror unit.

12. The circuit system according to claim 11, wherein each of the first to fifth transistors is a P-type MOS transistor, and each of the sixth to ninth transistors is a N-type MOS transistor.

13. The circuit system according to claim 11, wherein the current mirror unit comprises first to fourth native transistors, and drains of the first to fourth native transistors are electrically connected to drains of the first to fourth transistors, respectively, and sources of the first to fourth native transistors are electrically connected to sources of the sixth to ninth transistors, respectively, and gates of the first and fourth native transistors are electrically connected to a gate of the sixth transistor, and gates of the second native transistor and third native transistor are electrically connected to a gate of the seventh transistor.

14. The circuit system according to claim 13, wherein each of the first to fourth native transistors is a N-type native MOS transistor.

15. The circuit system according to claim 9, wherein the current-mode temperature compensation unit comprises a second impedance circuit, and a first terminal and a second terminal of the second impedance circuit are electrically connected to the third terminal of the current mirror unit and the ground voltage, respectively, and the second impedance circuit and the second circuit are electrically connected in parallel, and a connection node between the second impedance circuit and the second circuit receives the second sum current.

16. The circuit system according to claim 9, wherein each of the tenth and eleventh transistors is a PNP-type BJT transistor.

* * * * *